US009435145B2

(12) United States Patent
Lujan et al.

(10) Patent No.: US 9,435,145 B2
(45) Date of Patent: Sep. 6, 2016

(54) APPARATUS AND METHOD FOR PREVENTING MOVEMENT OF RELEASE MECHANISM OF A VEHICLE LATCH

(71) Applicants: Francisco Javier Lujan, Chihuahua (MX); Francisco Javier Vazquez, Chihuahua (MX)

(72) Inventors: Francisco Javier Lujan, Chihuahua (MX); Francisco Javier Vazquez, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 154 days.

(21) Appl. No.: 14/159,515

(22) Filed: Jan. 21, 2014

(65) Prior Publication Data

US 2014/0203573 A1 Jul. 24, 2014

Related U.S. Application Data

(60) Provisional application No. 61/754,677, filed on Jan. 21, 2013.

(51) Int. Cl.

| | |
|---|---|
| ***E05C 3/06*** | (2006.01) |
| ***E05B 77/36*** | (2014.01) |
| ***E05B 81/20*** | (2014.01) |
| ***E05B 81/00*** | (2014.01) |
| ***E05B 81/04*** | (2014.01) |
| ***E05B 81/06*** | (2014.01) |
| ***E05B 81/14*** | (2014.01) |
| ***E05B 81/42*** | (2014.01) |
| *E05C 3/00* | (2006.01) |

(52) U.S. Cl.

CPC ..... *E05B 77/36* (2013.01); *E05B 81/00* (2013.01); *E05B 81/04* (2013.01); *E05B 81/06* (2013.01); *E05B 81/14* (2013.01); *E05B 81/20* (2013.01); *E05B 81/42* (2013.01); *Y10T 292/1048* (2015.04)

(58) Field of Classification Search

CPC ..... E05B 81/00; E05B 81/04; E05B 81/20
USPC ..... 292/201, 279, 280
See application file for complete search history.

(56) References Cited

U.S. PATENT DOCUMENTS 4,664,430 A * 5/1987 Bernard ..... E05B 81/20 292/201
4,793,640 A * 12/1988 Stewart, Sr. ..... E05B 81/25 292/199

(Continued)

FOREIGN PATENT DOCUMENTS

| | | | |
|---|---|---|---|
| CN | 1556890 | A | 12/2004 |
| CN | 200952289 | Y | 9/2007 |
| JP | 358571 | U | 6/1991 |

OTHER PUBLICATIONS

CN Office Action for Application No. 201410027214.8; Date of Issue: Dec. 14, 2015.

(Continued)

*Primary Examiner* — Carlos Lugo
(74) *Attorney, Agent, or Firm* — Cantor Colburn LLP

(57) ABSTRACT

A latch is provided including a fork bolt configured to rotate between an unlatched position and a latched position. A bellcrank lever is operably coupled to the fork bolt via a detent lever. The bellcrank lever has an engagement ledge located adjacent a slot of the bellcrank lever. The engagement shelf prevents movement of a gear configured to move the detent lever via movement of the bellcrank lever.

16 Claims, 6 Drawing Sheets

(56) References Cited

U.S. PATENT DOCUMENTS

| | | | | |
|---|---|---|---|---|
| 5,632,515 | A | 5/1997 | Dowling | |
| 5,634,677 | A * | 6/1997 | Buscher | E05B 81/06 292/216 |
| 5,697,237 | A * | 12/1997 | Dilger | E05B 81/25 292/201 |
| 5,934,717 | A * | 8/1999 | Wirths | E05B 81/14 292/201 |
| 5,938,253 | A * | 8/1999 | Szablewski | E05B 81/14 292/201 |
| 6,338,508 | B1 * | 1/2002 | Kleefeldt | E05B 81/06 292/201 |
| 6,568,722 | B2 * | 5/2003 | Raffelsiefer | E05B 77/245 292/201 |
| 6,712,407 | B2 * | 3/2004 | Duriez | E05B 81/14 292/201 |
| 6,936,983 | B2 * | 8/2005 | Kachouh | E05B 81/06 292/201 |
| 7,032,937 | B2 * | 4/2006 | Boecker | E05B 81/14 292/201 |
| 7,261,333 | B2 * | 8/2007 | Tomaszewski | E05B 81/06 292/201 |
| 7,399,010 | B2 * | 7/2008 | Hunt | E05B 81/06 292/201 |
| 8,029,031 | B2 * | 10/2011 | Hunt | E05B 81/06 292/201 |
| 8,328,249 | B2 * | 12/2012 | Corrales | E05B 81/14 292/201 |
| 8,522,583 | B2 * | 9/2013 | Cumbo | E05B 81/06 292/201 |
| 8,622,443 | B2 * | 1/2014 | Tomaszewski | E05B 15/004 292/201 |

OTHER PUBLICATIONS

English Translation of CN Office Action for Application No. 201410027214.8; Date of Issue: Dec. 14, 2015.
English Translation to CN1556890A Abstract.
English Translation to CN200952289Y Abstract.

* cited by examiner

APPARATUS AND METHOD FOR PREVENTING MOVEMENT OF RELEASE MECHANISM OF A VEHICLE LATCH

CROSS REFERENCE TO RELATED APPLICATIONS

This application claims the benefit of U.S. Non-provisional application No. 61/754,677 filed Jan. 21, 2013, the contents of which are incorporated herein by reference thereto.

TECHNICAL FIELD

Exemplary embodiments of the present invention relate generally to a latch and, more particularly, to a latch having a release mechanism.

BACKGROUND

Conventional latches are used to restrain the movement of one member or element with respect to another. For example, conventional door latches restrain the movement of a door with respect to a surrounding door frame. The function of such latches is to hold the door secure within the frame until the latch is released and the door is free to open. Existing latches typically have mechanical connections linking the latch to actuation elements which can be actuated by a user to release the latch. Movement of the actuation elements is transferred through the mechanical connections and will cause the latch to release. The mechanical connections can be one or more rods, cables, gears, or other suitable elements or devices.

Some latches include an electromechanical linkage for pivoting a latch between a latched and an unlatched position. Activation of such a linkage often creates noise when adjacent components engage or contact one another. Latch sound quality can enhance or detract from the overall perception of quality by an end user about the construction of the vehicle. As a result, more emphasis is being placed on the ability of the latch to absorb any noise emissions that may occur during operation and activation of a release mechanism.

Accordingly, while existing latch mechanisms are suitable, the need for improvement remains, particularly in providing a latch mechanism having improved sound quality noise dampening and energy absorption.

SUMMARY OF THE INVENTION

According to an exemplary embodiment of the present invention, a latch is provided including a fork bolt configured to rotate between an unlatched position and a latched position. A bellcrank lever is operably coupled to the fork bolt via a detent lever. The bellcrank lever has an engagement ledge located adjacent a slot of the bellcrank lever. The engagement shelf prevents movement of a gear configured to move the detent lever via movement of the bellcrank lever.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

With reference to all of the FIGS., an exemplary latch 10 having a power release mechanism 20 for opening the latch 10 is illustrated. This latch 10 may be integrated into a component of a vehicle, such as a structural component adjacent a lift gate or trunk of the vehicle for example. Of course, other locations and uses of latch 10 are considered to be within the scope of various embodiments of the present invention.

Figure 1:
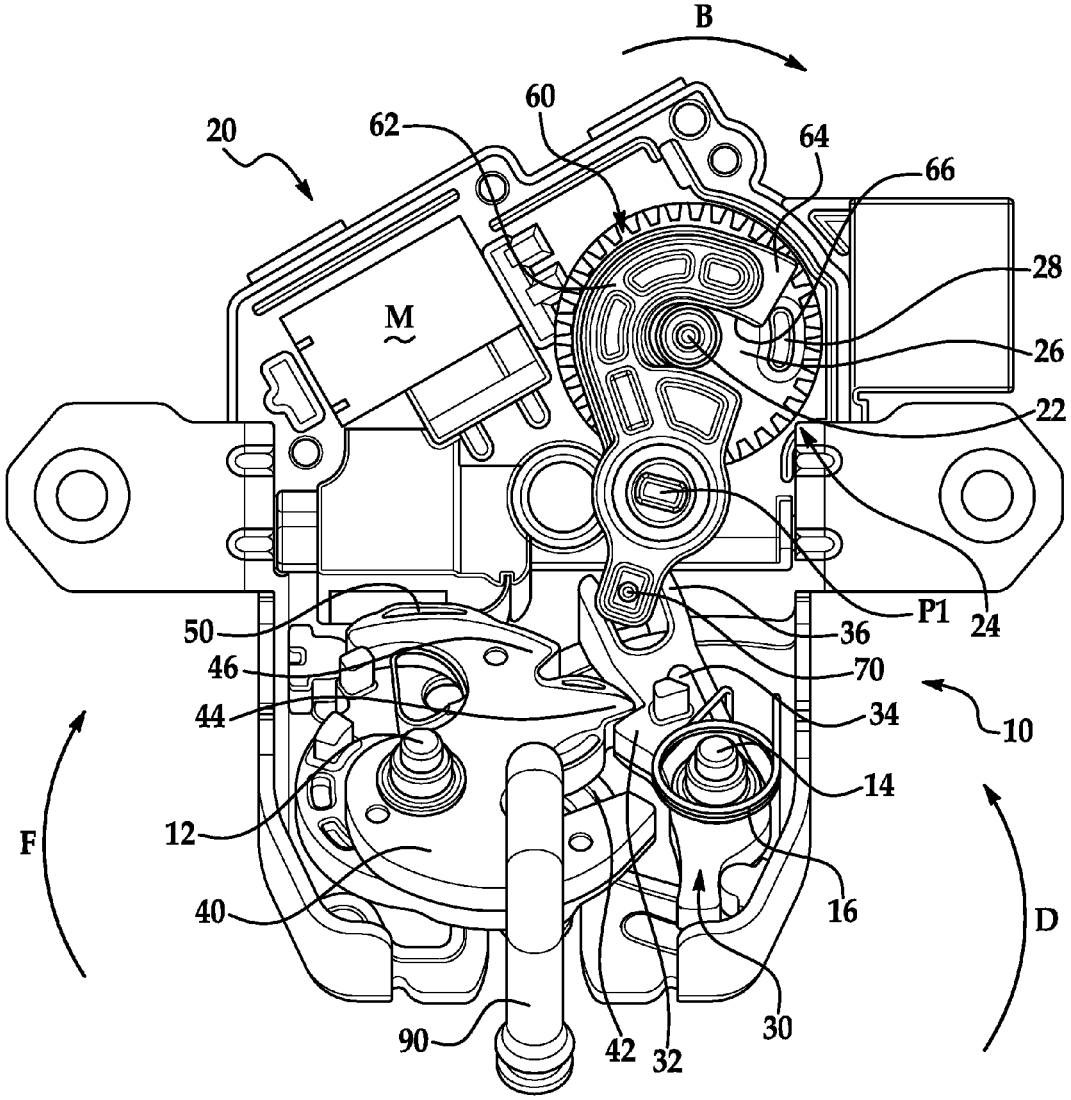
FIG. 1 is a perspective view of a latch in a primary latched position according to an embodiment of the invention.
Figure 2:
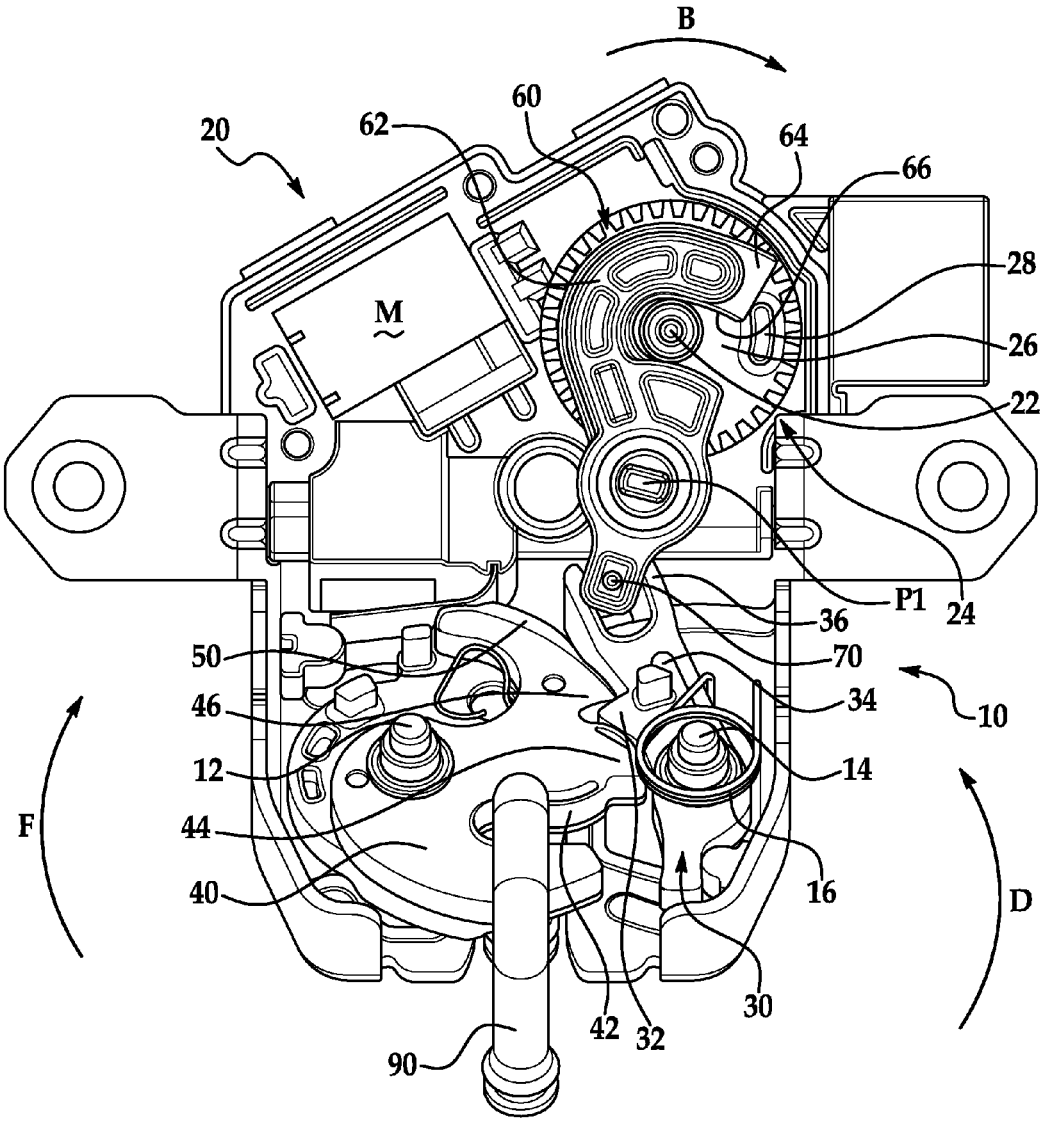
FIG. 2 is a perspective view of a latch in a secondary latched position according to an embodiment of the invention.

Referring now to FIGS. 1 and 2, the exemplary latch 10 is illustrated in a closed or latched position. The latch 10 includes a fork bolt 40 and a cooperating detent lever 30 for retaining the fork bolt 40 in the latched position. In one embodiment, the fork bolt 40 is made from metal over molded in plastic. The fork bolt 40 and the detent lever 30 are pivotally mounted to a frame of the latch 10 by studs 12 and 14 respectively. The fork bolt 40 is biased in the direction indicated by arrow F and the detent lever 30 is biased in the direction indicated by arrow D into engagement with the fork bolt 40. In one embodiment, each of the fork bolt 40 and the detent lever 30 are biased by a biasing mechanism, such as a torsion spring 16 for example. The fork bolt 40 has a slot or throat 42 for receiving and retaining a striker 90 located on a complementary vehicle component, such as a lift gate or trunk. The fork bolt 40 additionally includes a primary shoulder 44 and an intermediate secondary shoulder 46. A fork bolt protrusion 50 extends from a side surface 48 of the secondary shoulder 46 facing the detent lever 30. In one embodiment, the fork bolt protrusion 50 is formed as part of the over molded plastic of the forkbolt 40. The fork bolt protrusion 50 is configured to contact a portion of the detent lever 30 when rotating between a latched and an unlatched position. The detent lever 30 has a sector shaped catch 32 configured to positively engage each of the primary and secondary latch shoulders 44, 46 to hold the fork bolt 40 against the bias of its biasing mechanism in either a primary latched position (see FIG. 1) or a secondary latched position (see FIG. 2) respectively.

The power release mechanism 20 of the latch 10 has a gear 24 that is driven by a motor M of the power release mechanism 20. Gear 24 is mounted for rotation about a shaft 22. Gear 24 engages a helical gear or worm gear for example, connected to a drive shaft of the motor M. When the motor M is energized, the rotation of the worm gear is imparted to the gear 24. At least one gear protrusion 28 extends generally perpendicularly from a planar surface 26 of the gear 24. In one embodiment, the gear 24 includes two gear protrusions 28', 28" arranged 180 degrees apart from each other.

A bellcrank lever 60, rotatable about a pin P1 of the latch 10, is operably coupled to the gear 24 and the detent lever 30 such that motor M can rotate the detent lever 30 to allow the fork bolt 40 to transition from the closed position to the open position. In one embodiment, the bellcrank lever 60 includes a generally curved upper portion 62 extending from adjacent pin P1 to a first end 64. The curved upper portion 62 includes a slot 66 for receiving shaft 22 and a corresponding hub 23 of the gear 24. Slot 66 is configured to limit rotation of the bellcrank lever 60 about pin P1 in the direction indicated by arrow B. The upper portion 62 of the bellcrank lever 60 also includes an engagement ledge 68 positioned along a portion of slot 66, near pin P1 and adjacent shaft 22 (best shown in FIG. 3). The engagement ledge 68 extends from the bellcrank lever 60 towards the surface 26 of the gear 24 and parallel to an axis of rotation of pin P1. A second end 70 of the bellcrank lever 60 is disposed adjacent a first portion 36 of the detent lever 30. The second end 70 of the bellcrank lever 60 and the first portion 36 of the detent lever 30 may be pivotally coupled. Alternatively, the first portion 36 may be a protrusion extending generally perpendicularly from the planar surface 34 of the detent lever 30. The second end 70 of the bellcrank lever 60 is configured to engage the first portion 36 of the detent lever 30, and pivot the detent lever 30 in a direction opposite the direction indicated by arrow D, out of engagement with either the primary shoulder 44 or the secondary shoulder 46 of the fork bolt 40. Accordingly, the detent lever 30 and the bellcrank lever 60 are operably coupled together.

Figure 3:
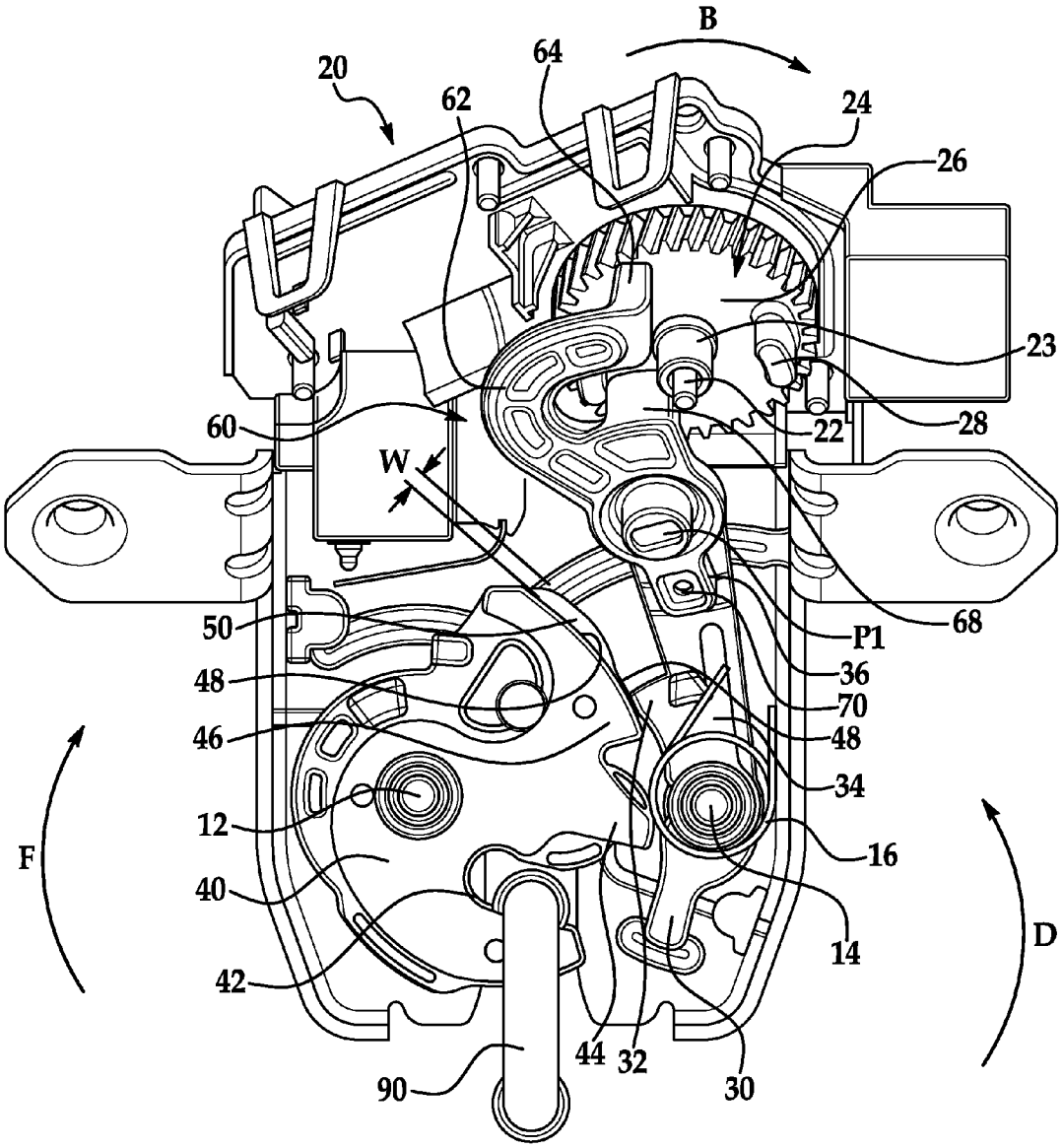
FIG. 3 is a perspective view of the latch after a power release mechanism is activated according to an embodiment of the invention.
Figure 4:
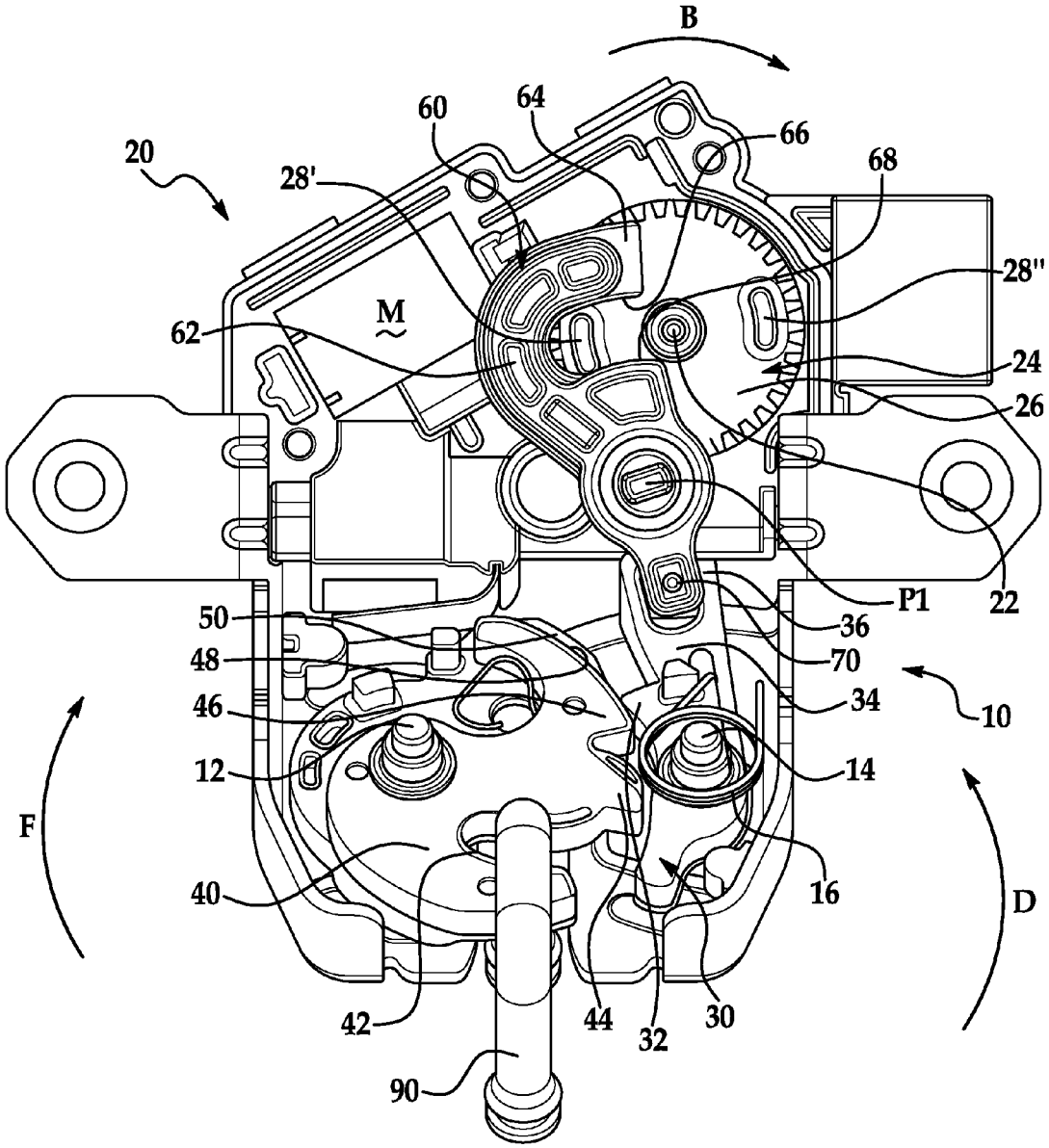
FIG. 4 is an alternate perspective view of the latch after a power release mechanism is activated according to an embodiment of the invention.

Referring now to FIGS. 2-4, when the latch 10 is in a either a primary latched or a secondary latched position, a first gear protrusion 28' of gear 24 is adjacent a first end 64 of the bellcrank lever 60 and a second gear protrusion 28" of the gear is positioned behind the upper portion 62 of the bellcrank lever 60. Activation of the power release mechanism 20 causes the gear 24 to rotate in the direction opposite the direction indicated by arrow B. As the gear 24 rotates, the first gear protrusion 28' engages the first end 64 of the bellcrank lever 60, causing the bellcrank lever 60 to pivot about pin P1 to a detent lever release position (FIG. 2). As the gear 24 and the bellcrank lever 60 rotate, the second gear protrusion 28" moves adjacent to and underneath the engagement ledge 68. This movement of the bellcrank lever 60 causes the second end 70 to contact the first portion 36 of the detent lever 30 and apply a force thereto such that detent lever 30 pivots about stud 14 and the sector shaped catch 32 disengages from the fork bolt 40. Once the bellcrank lever 60 reaches the detent lever release position, the first gear protrusion 28' will disengage from the bellcrank lever 60. Without the first gear protrusion 28' applying a force to the first end 64, the biasing force of biasing mechanism 16 biases the detent lever 30 in the direction indicated by arrow D such that the detent lever 30 and the bellcrank lever 60 pivot to a neutral or home position.

Figure 5:
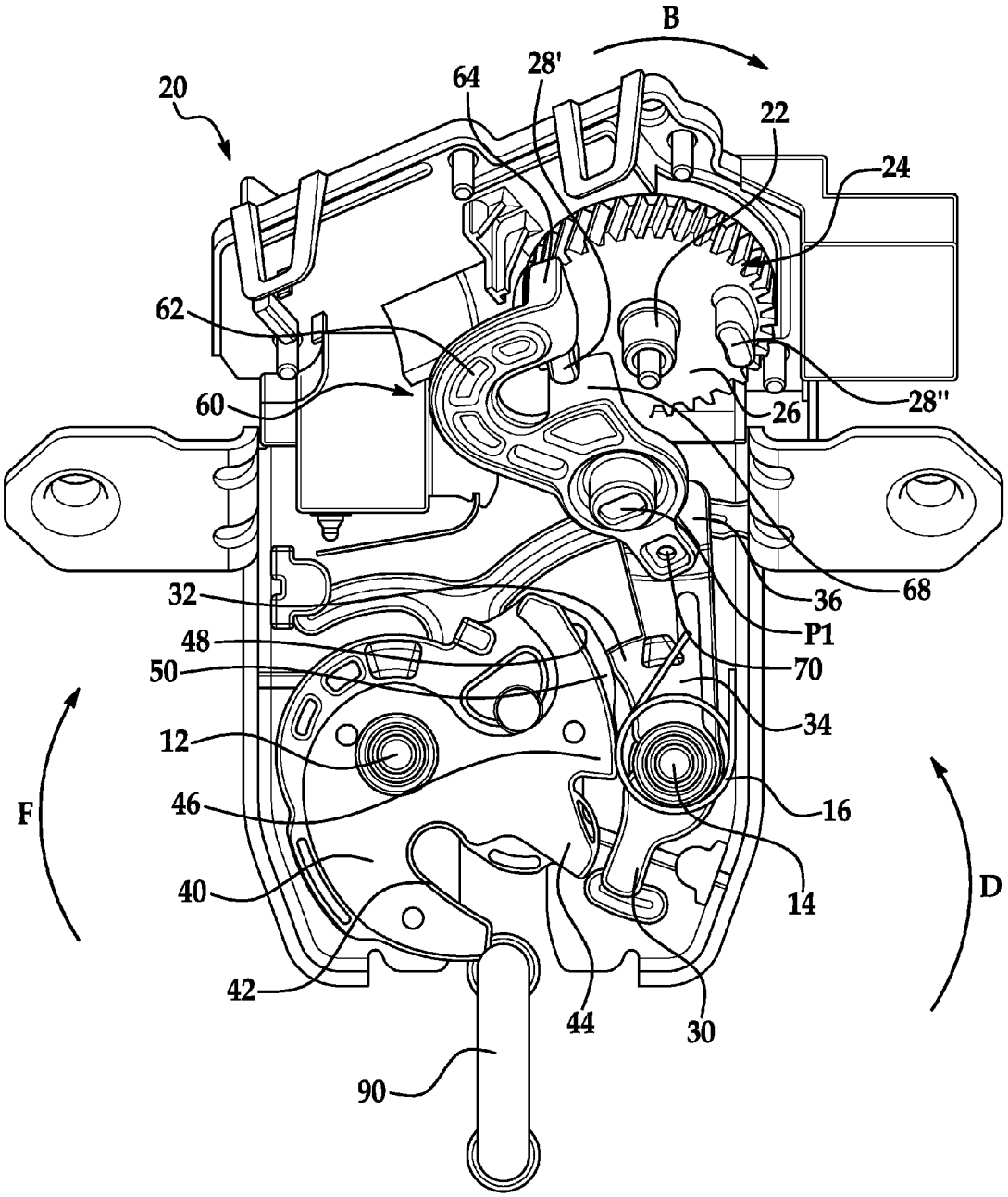
FIG. 5 is a perspective view of the latch in an unlatched position according to an embodiment of the invention.
Figure 6:
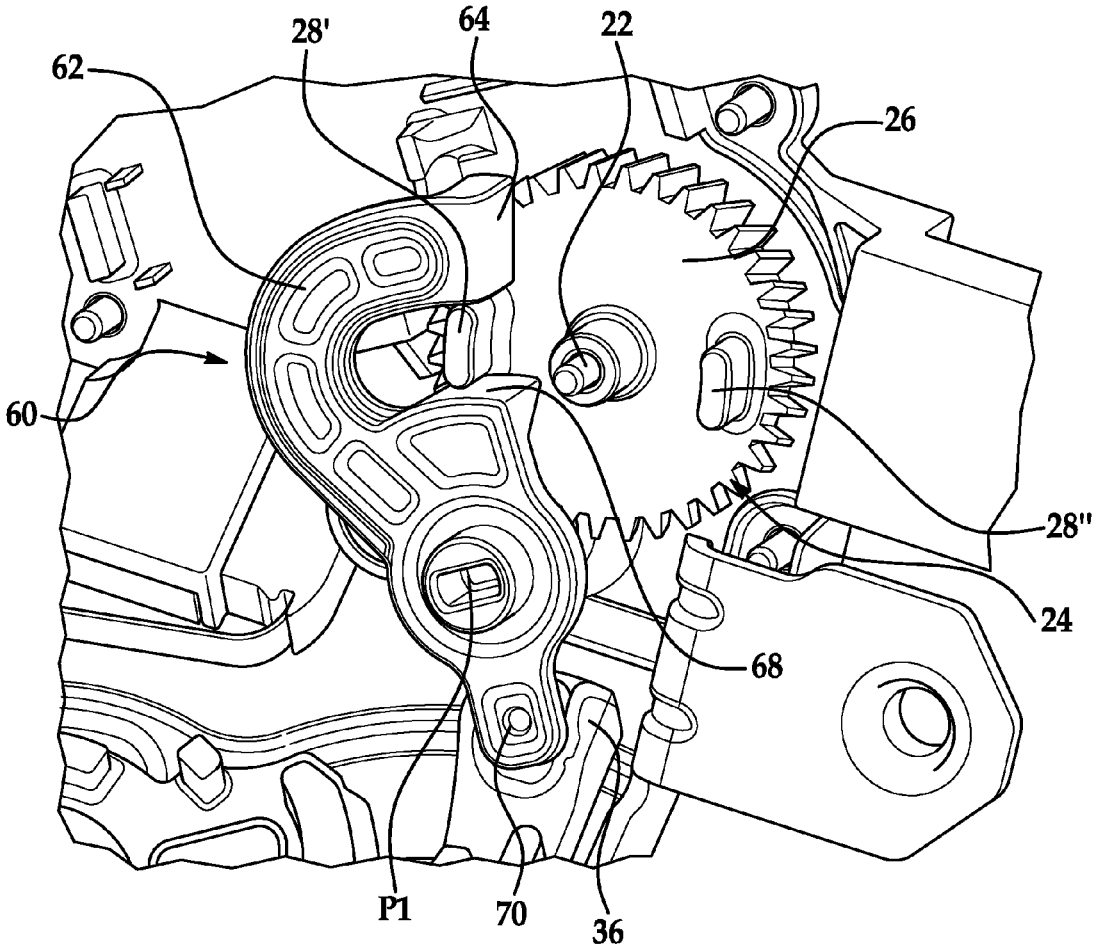
FIG. 6 is a perspective view of the power release mechanism of a latch when the latch is in an unlatched position accord to an embodiment of the invention.

Referring now to FIGS. 5 and 6, when the latch 10 is in an open or unlatched position and as the fork bolt 40 rotates to an open position, the fork bolt protrusion 50 engages an adjacent portion of the detent lever 30. As a result, the detent lever 30 is pivoted about stud 14 to an over-travel position. The extra width W of the fork bolt protrusion 50 causes further movement or rotation of the detent lever 30 and accordingly the bellcrank lever 60. When in the over-travel position, the detent lever 30 is pivoted opposite the direction indicated by arrow D further than when the bellcrank lever 60 is in a detent lever release position. In one embodiment, the width W of the fork bolt protrusion 50, and therefore the additional distance rotated by the detent lever 30, is about 1.5 mm. This movement of the detent lever 30 to the over-travel position causes a similar rotation of the bellcrank lever 60, such that the gear protrusion 28' adjacent the bellcrank lever 60 is positioned between the first end 64 and the engagement ledge 68 (best shown in FIG. 6). When the latch is fully open, the power release mechanism 20 cannot be used to disengage the detent lever 30 from the fork bolt protrusion 50 because contact between the engagement ledge 68 and the gear protrusion 28 prevents the gear 24 from rotating.

However, during a closing operation of the latch 10, receipt of the striker 90 within the throat 42 of the fork bolt 40 causes the fork bolt 40 to rotate in the direction opposite the direction indicated by arrow F towards a latched position and the detent lever 30 to slide relative to the fork bolt protrusion 50. The biasing force generated by spring 16 on the detent lever 30 will cause the bellcrank lever 60, operably coupled thereto, to pivot about pin P1 to a home position.

By restricting movement of the gear 24 when the forkbolt 40 is in an unlatched position, the "machine gunning effect" generated in conventional latches when the gear protrusions 28 engage and disengage the bellcrank lever 60 is averted.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch comprising:

a forkbolt configured to rotate between an unlatched position and a latched position;

a gear rotatably mounted about a shaft;

a bellcrank lever pivotally mounted to the latch and operably coupled to the fork bolt via a detent lever, wherein rotational movement of the gear causes pivotal movement of the bellcrank lever and the pivotal movement of the bellcrank lever causes pivotal movement of the detent lever, the bellcrank lever having an engagement ledge located adjacent a slot of the bellcrank lever, wherein the engagement ledge prevents rotational movement of the gear when the forkbolt is in the unlatched position, and wherein the engagement ledge does not prevent rotational movement of the gear when the forkbolt is in the latched position and the shaft is received within the slot; and a power release mechanism configured to selectively apply a force to a portion of the bellcrank lever via the gear in order to move the detent lever.

2. The latch according to claim 1, wherein the detent lever is configured to cooperate with the fork bolt to retain the fork bolt in a latched position.

3. The latch according to claim 2, wherein a second end of the bellcrank lever is positioned adjacent a first portion of the detent lever.

4. The latch according to claim 3, wherein the first portion of the detent lever is a protrusion extending generally perpendicular from a planar surface of the detent lever.

5. The latch according to claim 1, wherein the engagement ledge extends parallel to an axis of rotation of the bellcrank lever.

6. The latch according to claim 1, wherein the engagement ledge extends towards a surface of the gear.

7. The latch according to claim 1, wherein the power release mechanism comprises:

a motor; and wherein the gear has a gear protrusion configured to contact a portion of the bellcrank lever to move the bellcrank lever and the detent lever, wherein the portion is not the engagement ledge.

8. The latch according to claim 7, wherein the gear protrusion contacts a first end of the bellcrank lever to move the bellcrank lever and the detent lever.

9. The latch according to claim 7, wherein when the fork bolt is in an unlatched position, the gear protrusion is arranged adjacent the engagement ledge of the bellcrank lever.

10. The latch according to claim 7, further comprising a second gear protrusion arranged 180 degrees apart from the gear protrusion.

11. The latch according to claim 1, wherein the fork bolt includes a fork bolt protrusion.

12. The latch according to claim 11, wherein when the fork bolt is in an unlatched position, the fork bolt protrusion rotates the detent lever and the bellcrank lever to an overtravel position.

13. The latch according to claim 11, wherein the fork bolt protrusion has a width of about 1.5 mm.

14. The latch according to claim 13, wherein the fork bolt protrusion is formed on the over molded plastic.

15. The latch according to claim 11, wherein the fork bolt is made from metal over molded in plastic.

16. A latch, comprising:

a forkbolt configured to rotate between an unlatched position and a latched position, wherein the forkbolt has a forkbolt protrusion;

a gear rotatably mounted about a shaft;

a bellcrank lever pivotally mounted to the latch and operably coupled to the fork bolt via a detent lever, wherein rotational movement of the gear causes pivotal movement of the bellcrank lever and the pivotal movement of the bellcrank lever causes pivotal movement of the detent lever, the bellcrank lever having an engagement ledge located adjacent a slot of the bellcrank lever, wherein the engagement ledge prevents rotational movement of the gear when the forkbolt is in the unlatched position, and wherein the engagement ledge does not prevent rotational movement of the gear when the forkbolt is in the latched position and the shaft is received within the slot;

a power release mechanism configured to selectively apply a force to a portion of the bellcrank lever via the gear in order to move the detent lever; and wherein when the fork bolt is in an unlatched position, the fork bolt protrusion rotates the detent lever and the bellcrank lever to an overtravel position such that the engagement ledge prevents movement of the gear by contacting a protrusion of the gear.

* * * * *